US007870864B2

(12) United States Patent
Bertsch et al.

(10) Patent No.: US 7,870,864 B2
(45) Date of Patent: Jan. 18, 2011

(54) BELT-DRIVEN SPRAY ASSEMBLY FOR A DISHWASHER

(75) Inventors: Roger J. Bertsch, Stevensville, MI (US); Andrei Tres, Joinville (BR); Luis F. Welin, Curitiba-Parana (BR); Lorraine J. Westlake, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 190 days.

(21) Appl. No.: 12/340,970

(22) Filed: Dec. 22, 2008

(65) Prior Publication Data

US 2010/0154845 A1 Jun. 24, 2010

(51) Int. Cl.
*B08B 3/02* (2006.01)

(52) U.S. Cl. ..... 134/172; 134/180; 134/198

(58) Field of Classification Search ..... 134/135, 134/172, 180, 198
See application file for complete search history.

(56) References Cited

U.S. PATENT DOCUMENTS

| | | | | |
|---|---|---|---|---|
| 1,421,543 | A * | 7/1922 | Olson | 15/74 |
| 1,831,223 | A * | 11/1931 | Anstiss | 239/243 |
| 2,596,693 | A * | 5/1952 | Karlstrom | 134/112 |
| 2,748,944 | A | 6/1956 | Kalinske | |
| 2,750,229 | A | 6/1956 | Cammann | |
| 3,095,885 | A | 7/1963 | Hertell | |
| 3,708,120 | A | 1/1973 | Camprubi et al. | |
| 4,981,268 | A * | 1/1991 | Hour | 239/752 |
| 5,842,492 | A | 12/1998 | Lee | |
| 5,944,037 | A | 8/1999 | Sinyong et al. | |
| 2004/0255992 | A1 | 12/2004 | Eiermann | |
| 2005/0011544 | A1 | 1/2005 | Rosenbauer et al. | |
| 2005/0039777 | A1 | 2/2005 | Jerg et al. | |
| 2006/0162744 | A1 | 7/2006 | Walkden | |

FOREIGN PATENT DOCUMENTS

| | | | |
|---|---|---|---|
| EP | 0836829 | A2 | 4/1998 |
| GB | 2001523 | A | 2/1979 |
| JP | 10080393 | A | 3/1998 |
| JP | 10117993 | A | 5/1998 |
| JP | 10146311 | A1 | 6/1998 |

* cited by examiner

*Primary Examiner*—Frankie L Stinson
(74) *Attorney, Agent, or Firm*—John W. Morrison; Barnes & Thornburg LLP

(57) ABSTRACT

A dishwasher includes a spray assembly positioned in the wash chamber of the dishwasher's tub. The spray assembly includes a pump outlet that rotates relative to the bottom wall of the tub. One end of a flexible hose is secured to the pump outlet. The other end of the pump outlet is secured a belt that advances around a number of pulleys. Water is sprayed from the flexible hose via a number of nozzles.

21 Claims, 3 Drawing Sheets

BELT-DRIVEN SPRAY ASSEMBLY FOR A DISHWASHER

TECHNICAL FIELD

The present disclosure relates generally to a dishwasher and more particularly to a belt-driven spray assembly for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dish racks which support such wares. During a cleaning cycle, the dishwasher sprays water and/or a wash chemistry on the wares in the dish racks.

SUMMARY

According to one aspect, a dishwasher includes a spray assembly positioned in the wash chamber of the dishwasher's tub. The spray assembly includes a pump outlet that rotates relative to the bottom wall of the tub. One end of a flexible hose is secured to the pump outlet. The other end of the pump outlet is secured a belt that advances around a number of pulleys. Water is sprayed from the flexible hose via a number of nozzles.

According to another aspect, a dishwasher includes a tub defining a washing chamber. The tub includes a bottom wall. A number of dish racks are positioned in the washing chamber. A rotating pump outlet extends out of the bottom wall. A number of pulleys are secured to the bottom wall of the tub. A belt is advanced around the number of pulleys. The dishwasher also includes a flexible hose that has a number of nozzles. A first end of the flexible hose is coupled to the pump outlet. A second end of the flexible hose is secured to the belt.

The bottom wall of the tub has a recirculation sump which extends downwardly from an upper surface of the bottom wall. A pump inlet draws from the sump. The rotating pump outlet extends out of the recirculation sump.

In some embodiments, the bottom wall of the tub has four corner areas. One of each of four pulleys is proximate to each of the four corner areas of the tub.

The pulleys may be arranged such that the belt is generally square-shaped when positioned on the pulleys.

One of the pulleys may be coupled to a drive motor.

A clip may be used to secure the second end of the flexible hose to the belt.

The rotating pump outlet may be positioned in the center of the bottom wall of the tub.

According to another aspect, a dishwasher includes a tub defining a washing chamber. The tub includes a bottom wall. A number of dish racks are positioned in the washing chamber. A pump outlet rotates relative to the bottom wall of the tub. The dishwasher also includes four pulleys secured to the bottom wall of the tub. A belt is advanced around the four pulleys. A first end of a flexible hose is coupled to the pump outlet, with its second end being secured to the belt. The flexible hose has a number of nozzles.

The bottom wall of the tub has a recirculation sump which extends downwardly from an upper surface of the bottom wall. The rotating pump outlet extends out of the recirculation sump.

In some embodiments, the bottom wall of the tub has four corner areas. One of each of four pulleys is positioned in each of the four corner areas of the tub.

The pulleys may be arranged such that the belt is generally square-shaped when positioned on the pulleys.

One of the pulleys may be coupled to a drive motor.

A clip may be used to secure the second end of the flexible hose to the belt.

The rotating pump outlet may be positioned in the center of the bottom wall of the tub.

According to yet another aspect, a dishwasher includes a tub defining a washing chamber. The tub includes a bottom wall. A number of dish racks are positioned in the washing chamber. A pump outlet rotates relative to the bottom wall of the tub. A belt is positioned in the washing chamber. A first end of a flexible hose is coupled to the pump outlet, with its second end being secured to the belt. The flexible hose has a number of nozzles.

The bottom wall of the tub has a recirculation sump which extends downwardly from an upper surface of the bottom wall. A pump inlet draws from the sump. The rotating pump outlet extends out of the recirculation sump.

The dishwasher may also include a number of pulleys proximate to the bottom wall of the tub so as to rotate relative to the tub. The belt is advanced around the number of pulleys.

The pulleys may be arranged such that the belt is generally square-shaped when positioned on the pulleys.

One of the pulleys may be coupled to a drive motor.

In some embodiments, the bottom wall of the tub has four corner areas. One of each of four pulleys is positioned in each of the four corner areas of the tub.

A clip may be used to secure the second end of the flexible hose to the belt.

The rotating pump outlet may be positioned in the center of the bottom wall of the tub.

BRIEF DESCRIPTION OF THE DRAWINGS

The detailed description particularly refers to the following figures, in which.

DETAILED DESCRIPTION OF THE DRAWINGS

Figure 1:
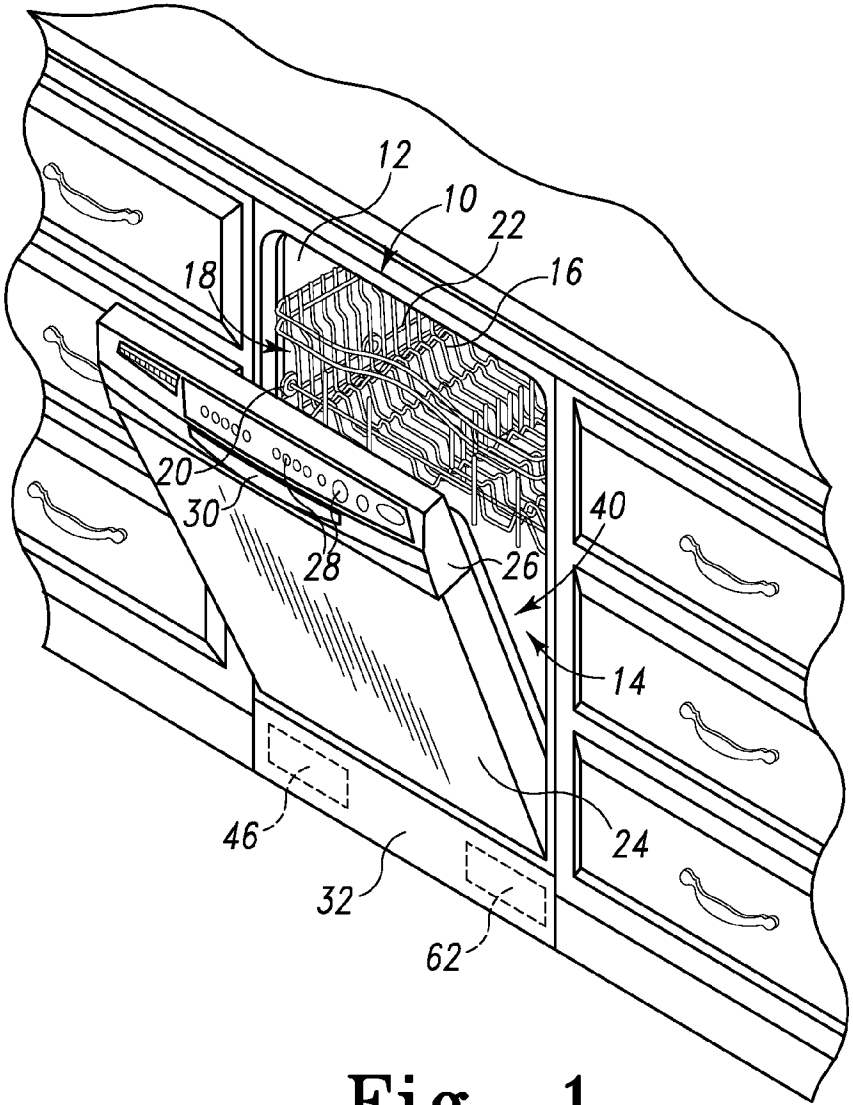
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish rack 16 and the tub 12. The roller assemblies 18 allow the dish racks 16 to extend from, and retract back into, the tub 12. Such movement facilitates the loading and unloading of the dish racks 16. The roller assemblies 18 include a number of rollers 20 which roll along the top of, and in some cases the top and bottom of, a corresponding support rail 22.

A door 24 is hinged to the lower front edge of the tub 12. The door 24 permits access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, that are used to control operation of the dishwasher 10. A handle 30 is also included in the control panel 26. The handle 30 is operable by a user to unlatch the door 24 so that it may be opened by a user.

A machine compartment 32 is located below the tub 12. The machine compartment 32 is sealed from the tub 12. In other words, unlike the tub 12 which fills with water and is exposed to water spray, the machine compartment 32 does not fill with water and is not exposed to water spray during operation of the dishwasher 12. The machine compartment 32 houses components such as the dishwasher's water pump(s) and valve(s), along with the associated wiring and plumbing.

Figure 2:
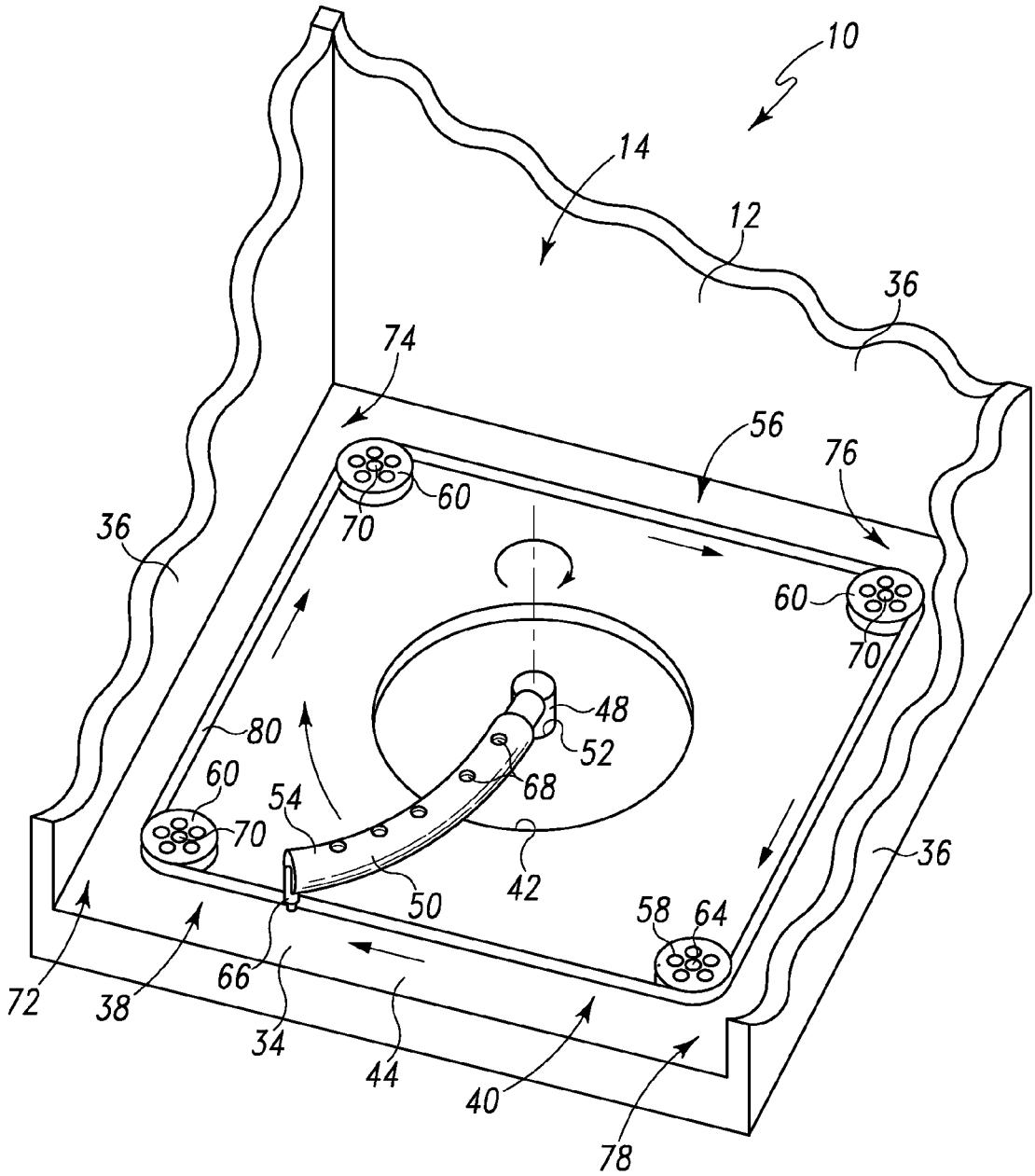
FIG. 2 is a fragmentary perspective view of the tub of the dishwasher of FIG. 1.

Referring now to FIG. 2, there is shown the dishwasher's tub 12 in greater detail. The tub 12 includes a bottom wall 34 having a number of side walls 36 extending upwardly therefrom to define the washing chamber 14. The open front side 38 of the tub 12 defines an access opening 40 of the dishwasher 10. User access to the dish racks 16 positioned in the washing chamber 14 is provided through the access opening 40. As such, when the door 24 is closed, user access to the dish racks 16 is prevented, whereas user access to the dish racks 16 is permitted when the door 24 is open. The door 24 also functions to seal the dishwasher 10 so that water does not escape the access opening 40 of the dishwasher 10 during a wash cycle.

Figure 3:
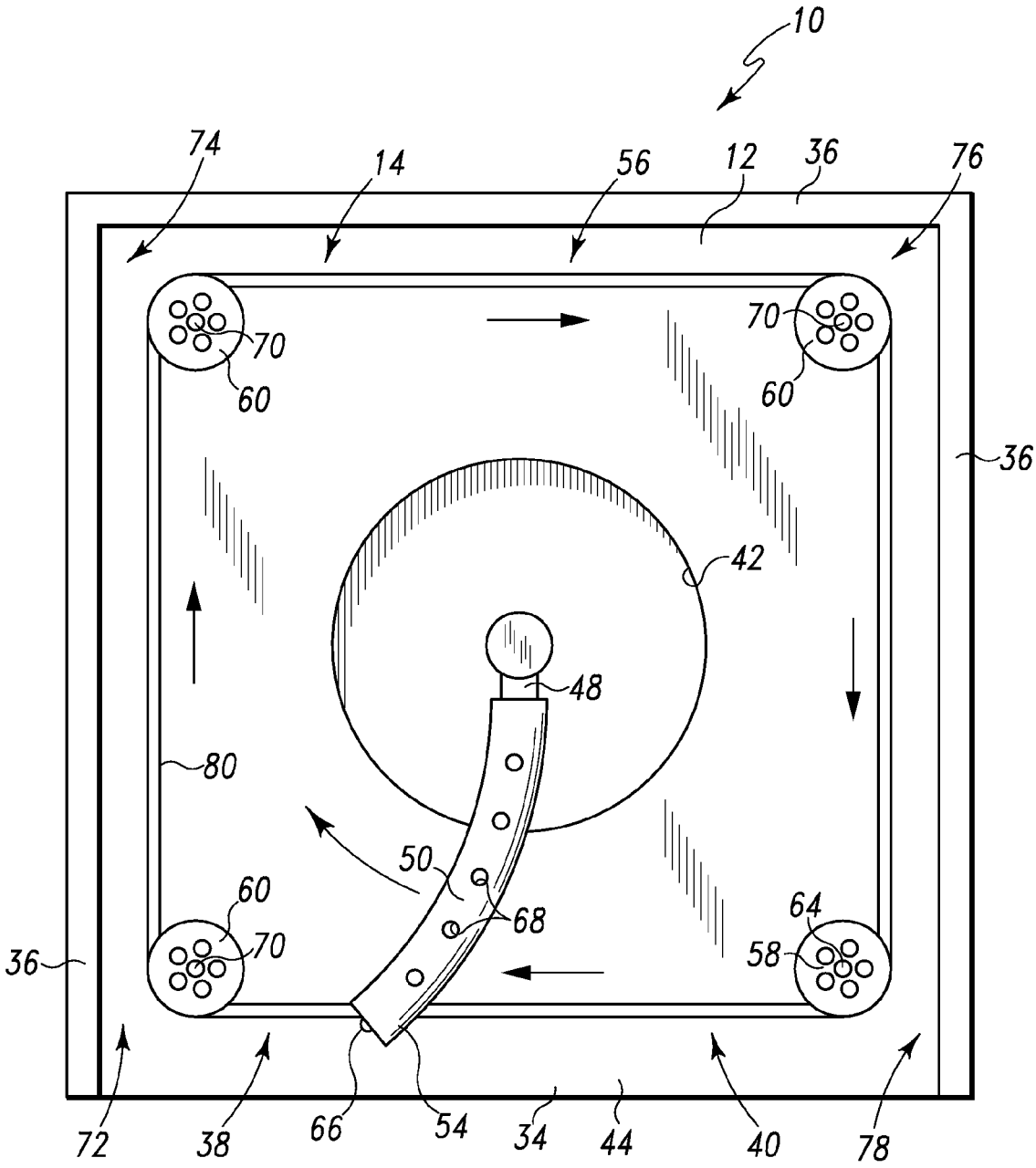
FIG. 3 is plan view of the tub of FIG. 2.

The bottom wall 34 of the tub 12 has a recirculation sump 42 formed therein. The recirculation sump 42 is formed (e.g., stamped or molded) into the bottom wall 34 of the tub 12. In particular, as shown in FIGS. 2 and 3, the recirculation sump 42 defines a reservoir which extends downwardly in a direction away from the upper surface 44 of the bottom wall 34 of the tub 12. The sloped configuration of the tub's bottom wall 34 directs water and/or wash chemistry (i.e., water and/or detergents, enzymes, surfactants, and other cleaning or conditioning chemistry) into the recirculation sump 42 during a wash cycle. Such water and/or wash chemistry is drained from the recirculation sump 42 and re-circulated onto the dish racks 16 by a pump 46 located in the mechanical compartment 32. The outlet 48 of the pump 46 extends out of the recirculation sump 42 and is coupled to a flexible hose 50. The pump outlet 48 and the flexible hose 50 are rotated relative to the tub's bottom wall 34 to spray water and/or wash chemistry onto the dish racks 16 (and hence the wares being washed).

As shown in FIG. 2, the pump outlet 48 extends through a sealed hole 52 formed in the bottom wall 34 of the tub 12. In the illustrative embodiment described herein, the pump outlet 48 is embodied as a rotating coupling that has one end coupled to the pump 46, with its other end being received into the flexible hose 50. The pump outlet 48 may be embodied as a monolithic component or may include a number of separate components. A sealed bearing (not shown) may be used to facilitate rotation of the pump outlet 48 relative to the tub 12.

As shown in FIGS. 2 and 3, the distal end 54 of the flexible hose 50 is moved within the washing chamber 14 by a belt drive assembly 56. The drive assembly 56 includes a drive pulley 58 and three idler pulleys 60. In the illustrative embodiment described herein, the drive pulley 58 is located in the front right corner of the wash tub 12. It should be appreciated, however, that the drive pulley 58 may be located in any of the other locations within the tub 12. A drive motor 62 located in the machine compartment 32 has an output shaft 64 that is coupled to the drive pulley 58. Similarly to the pump outlet 48, the output shaft 64 of the drive motor 62 extends through a sealed hole (not shown) formed in the bottom wall 34 of the tub 12. The drive motor 62 is operable to drive the drive pulley 58. In other words, rotation of the output shaft 64 causes similar rotation of the drive pulley 58.

Each of the idler pulleys 60 rotates about a support shaft 70. The support shafts 70 extend upwardly away from the upper surface 44 of the bottom wall 34 of the tub 12. The shafts 70 may be directly secured to the tub 12 or may be secured to the tub 12 through an intermediate support structure such as a clip (not shown).

A drive belt 80 is advanced around each of the pulleys 58, 60. Specifically, rotation of the drive pulley 58 by the drive motor 62 causes the belt 80 to be advanced around the pulleys 58, 60.

The distal end 54 of the flexible hose 50 is secured to the drive belt 80. In particular, a clip 66 is located on the distal end 54 of the flexible hose 50. The clip 66 is secured to the belt 80. In the illustrative embodiment described herein, a steel wire (not shown) or other similar structure may be stitched or otherwise formed into the belt 80. The clip 66 is secured to the steel wire thereby securing the distal end 54 of the flexible hose 50 to the belt 80.

A biasing element such as a torsion spring secured to a support arm (not shown) is coupled to one of the pulleys 58, 60. The biasing element urges the pulley 58, 60 outwardly away from the center of the bottom wall 34 to maintain a desired amount of tension on the belt 80.

As alluded to above, the distal end 54 of the flexible hose 50 is driven by the belt 80. Namely, as the belt 80 is advanced around the pulleys 58, 60, the distal end 54 of the flexible hose 50 is likewise moved along such a path. This in turn causes rotation of the pump outlet 48 relative to the bottom wall 34 of the tub 12. As shown in FIGS. 2 and 3, the flexible hose 50 has a number of nozzles 68, with its distal end 54 being capped or otherwise sealed. Water (or wash chemistry) pumped into the flexible hose 50 by the pump 46 is sprayed out of the flexible hose 50 through the nozzles 68 during rotation of the flexible hose 50. In the illustrative embodiment described herein, the nozzles 68 are embodied simply as holes formed in the flexible hose 50. However, it is within the scope of the disclosure for the nozzles 68 to include a tip or other similar structure that is inserted into the holes of the flexible hose 50. Such inserts may be useful in configuring the spray direction or spray pattern of the flexible hose 50.

As shown most clearly in the plan view of FIG. 3, the bottom wall 34 of the tub 12 is generally square-shaped, and, as such, it has four corner areas 72, 74, 76, 78. One of the pulleys 58, 60 is positioned in each of the corner areas 72, 74, 76, 78. As such, the belt 80 is likewise generally square-shaped when it is installed on the pulleys 58, 60—i.e., it follows a generally square-shaped path as it is advanced around the pulleys 58, 60. In such a way, water and/or wash chemistry may be sprayed into a relatively large portion of the tub 12, including its corners.

In operation, water (and/or wash chemistry) is sprayed onto the wares located in the dish racks 16 by the belt-driven spray system described herein. Namely, water (and/or wash chemistry) is drawn by the pump 46 from the recirculation sump 42 (or from a water supply line) and expelled through the pump's outlet 48 into the flexible hose 50. The water (and/or wash chemistry) then exits the flexible hose 50 through the nozzles 68 where it is sprayed on the dish racks 16 (and hence the wares located therein).

The flexible hose 50 is rotated during such spraying to ensure coverage of the entire tub 12. Namely, the drive motor 62 is operated to drive the drive pulley 58 which, in turn, causes movement of belt 80 around the pulleys 58, 60. As the belt 80 is advanced around the pulleys 58, 60, the pump outlet 48 rotates thereby allowing the distal end 54 of the flexible hose 50 to move with the belt 80. In doing so, the belt 80, and hence the distal end 54 of the flexible hose 50, follows a generally square-shaped path within the tub 12 as it is advanced around the pulleys 58, 60. As the distal end 54 of the flexible hose 50 nears one of the corners (i.e., nears one of the pulleys 58, 60), the flexible hose 50 extends thereby spraying water (and/or wash chemistry) onto the portion of the dish racks 16 located in that corner of the tub 12. As the distal end 48 of the flexible hose 50 moves along the sides, front, or back of the tub 12 (i.e., not in one of the corners), the flexible hose 50 assumes a more curved orientation thereby continuing to spray the portion of the dish racks 16 located directly above it. In such a way, water and/or wash chemistry is sprayed into a relatively large portion of the tub 12, including its corners.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, the tub comprising a bottom wall, a number of dish racks positioned in the washing chamber, a rotating pump outlet extending out of the bottom wall, a number of pulleys proximate to the bottom wall of the tub, a belt advanced around the number of pulleys, and a flexible hose having a number of nozzles, wherein (i) a first end of the flexible hose is coupled to the pump outlet, and (ii) a second end of the flexible hose is secured to the belt.

2. The dishwasher of claim 1, wherein:

the bottom wall of the tub has defined therein a recirculation sump which extends downwardly from an upper surface of the bottom wall, and the rotating pump outlet extends out of the recirculation sump.

3. The dishwasher of claim 1, wherein:

the bottom wall of the tub is has four corner areas, the number of pulleys comprises four pulleys, and one of each of the four pulleys is positioned in each of the four corner areas of the tub.

4. The dishwasher of claim 1, wherein:

the number of pulleys comprises four pulleys, and the four pulleys are arranged such that the belt is generally square-shaped when positioned on the four pulleys.

5. The dishwasher of claim 1, wherein:

the bottom wall of the tub is generally square-shaped, the number of pulleys comprises four pulleys, and the four pulleys are arranged such that the belt is generally square-shaped when positioned on the four pulleys.

6. The dishwasher of claim 5, wherein one of the four pulleys is coupled to a drive motor.

7. The dishwasher of claim 1, further comprising a clip which secures the second end of the flexible hose to the belt.

8. The dishwasher of claim 1, wherein the rotating pump outlet is positioned in the center of the bottom wall of the tub.

9. A dishwasher, comprising:

a tub defining a washing chamber, the tub comprising a bottom wall, a number of dish racks positioned in the washing chamber, a pump outlet, the pump outlet rotating relative to the bottom wall of the tub, four pulleys proximate to the bottom wall of the tub, a belt advanced around the four pulleys, and a flexible hose having a number of nozzles, wherein (i) a first end of the flexible hose is coupled to the pump outlet, and (ii) a second end of the flexible hose is secured to the belt.

10. The dishwasher of claim 9, wherein:

the bottom wall of the tub has defined therein a recirculation sump which extends downwardly from an upper surface of the bottom wall, and the pump outlet extends out of the recirculation sump.

11. The dishwasher of claim 9, wherein:

the bottom wall of the tub is generally square-shaped thereby defining four corner areas, one of each of the four pulleys is positioned in each of the four corner areas of the tub.

12. The dishwasher of claim 9, wherein the four pulleys are arranged such that the belt is generally square-shaped when positioned on the four pulleys.

13. The dishwasher of claim 9, wherein one of the four pulleys is coupled to a drive motor.

14. The dishwasher of claim 9, further comprising a clip which secures the second end of the flexible hose to the belt.

15. The dishwasher of claim 9, wherein the pump outlet is positioned in the center of the bottom wall of the tub.

16. A dishwasher, comprising:

a tub defining a washing chamber, the tub comprising a bottom wall, a number of dish racks positioned in the washing chamber, a pump outlet, the pump outlet rotating relative to the bottom wall of the tub, a belt positioned in the washing chamber, and a flexible hose having a number of nozzles, wherein (i) a first end of the flexible hose is coupled to the pump outlet, and (ii) a second end of the flexible hose is secured to the belt.

17. The dishwasher of claim 16, wherein:

the bottom wall of the tub has defined therein a recirculation sump which extends downwardly from an upper surface of the bottom wall, and the pump outlet extends out of the recirculation sump.

18. The dishwasher of claim 16, further comprising a number of pulleys proximate to the bottom wall of the tub so as to rotate relative to the tub, wherein the belt is advanced around the number of pulleys.

19. The dishwasher of claim 18, wherein:

the bottom wall of the tub is generally square-shaped thereby defining four corner areas, and one of the number of pulleys is positioned in each of the four corner areas of the tub.

20. The dishwasher of claim 19, wherein the number of pulleys are arranged such that the belt is generally square-shaped when positioned on the number of pulleys.

21. The dishwasher of claim 16, wherein the pump outlet is positioned near the center of the bottom wall of the tub.

* * * * *